US011085701B2

(12) United States Patent
He et al.

(10) Patent No.: US 11,085,701 B2
(45) Date of Patent: Aug. 10, 2021

(54) DOUBLE-ROW BENT HEAT EXCHANGER

(71) Applicant: SANHUA (HANGZHOU) MICRO CHANNEL HEAT EXCHANGER CO., LTD., Hangzhou (CN)

(72) Inventors: Yan He, Hangzhou (CN); Jing Zhou, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 284 days.

(21) Appl. No.: 16/067,227

(22) PCT Filed: Dec. 6, 2016

(86) PCT No.: PCT/CN2016/108738
§ 371 (c)(1),
(2) Date: Jun. 29, 2018

(87) PCT Pub. No.: WO2017/114107
PCT Pub. Date: Jul. 6, 2017

(65) Prior Publication Data

US 2019/0011192 A1 Jan. 10, 2019

(30) Foreign Application Priority Data

Dec. 30, 2015 (CN) ..... 201511027379.6

(51) Int. Cl.
*F28D 7/16* (2006.01)
*F28F 9/02* (2006.01)
(Continued)

(52) U.S. Cl.
CPC ..... *F28D 7/1684* (2013.01); *B21D 53/085* (2013.01); *F28D 1/0476* (2013.01);
(Continued)

(58) Field of Classification Search
CPC .... F28D 1/0471; F28D 1/0435; F28D 1/0475; F28D 1/0476; F28D 1/05391;
(Continued)

(56) References Cited

U.S. PATENT DOCUMENTS 5,531,268 A * 7/1996 Hoshino ..... F28D 1/0476 165/153
7,503,382 B2 * 3/2009 Maezawa ..... F25B 39/00 165/144
(Continued)

FOREIGN PATENT DOCUMENTS

CN 101782337 A 7/2010
CN 103196259 A 7/2013
(Continued)

OTHER PUBLICATIONS

International Search Report and Written Opinion of the International Searching Authority for PCT International Application No. PCT/CN2016/108738 dated Mar. 15, 2017.
(Continued)

*Primary Examiner* — Tho V Duong
(74) *Attorney, Agent, or Firm* — Howard & Howard Attorneys PLLC

(57) ABSTRACT

A double-row bent heat exchanger is provided. The heat exchanger includes: a first header and a second header; flat tubes each divided into a first straight segment connected to the first header, a second straight segment connected to the second header and a twisted segment connected between the first straight segment and the second straight segment, along a length direction of the flat tube; and fins disposed between adjacent first straight segments and between adjacent second straight segments. The flat tube is bent at the twisted segment around a first bending axis (L) to provide a first bending portion. The first header and the second header are
(Continued)

bent around at least one second bending axis (K) to provide at least one second bending portion.

10 Claims, 14 Drawing Sheets

(51) Int. Cl.

| | |
|---|---|
| ***F28D 1/053*** | (2006.01) |
| ***F28F 1/12*** | (2006.01) |
| ***F28D 1/047*** | (2006.01) |
| ***B21D 53/08*** | (2006.01) |
| ***F28F 1/32*** | (2006.01) |
| *F28D 1/02* | (2006.01) |
| *F24F 1/18* | (2011.01) |

(52) U.S. Cl.
CPC ..... *F28D 1/05366* (2013.01); *F28D 1/05391* (2013.01); *F28F 1/126* (2013.01); *F28F 1/32* (2013.01); *F28F 9/02* (2013.01); *F28F 9/0243* (2013.01); *F28F 9/0275* (2013.01); *F24F 1/18* (2013.01); *F28D 2001/0273* (2013.01); *F28F 9/0229* (2013.01); *F28F 2210/10* (2013.01)

(58) Field of Classification Search
CPC ..... F28D 7/1684; F28F 1/32; F28F 9/0243; F28F 9/02; F28F 9/0275; B21D 53/085
See application file for complete search history.

(56) References Cited

U.S. PATENT DOCUMENTS

| | | | | |
|---|---|---|---|---|
| 7,900,689 | B2 * | 3/2011 | Samuelson | B23P 15/26 165/176 |
| 9,115,939 | B2 * | 8/2015 | Huazhao | F28D 1/05383 |
| 2007/0169922 | A1 | 7/2007 | Pautler | |
| 2007/0227695 | A1 * | 10/2007 | Beamer | F28D 1/05366 165/76 |
| 2010/0181058 | A1 | 7/2010 | Huazhao et al. | |
| 2011/0094257 | A1 * | 4/2011 | Rusignuolo | F28D 1/0443 62/498 |
| 2016/0169586 | A1 | 6/2016 | Ito et al. | |
| 2017/0059252 | A1 | 3/2017 | Zhou et al. | |
| 2018/0299205 | A1 * | 10/2018 | Rahhal | F28D 1/047 |

FOREIGN PATENT DOCUMENTS

| | | | |
|---|---|---|---|
| CN | 203083203 | U | 7/2013 |
| CN | 203132214 | U | 8/2013 |
| CN | 103925745 | A | 7/2014 |
| CN | 204085299 | U | 1/2015 |
| CN | 104344745 | A | 2/2015 |
| CN | 204141899 | U | 2/2015 |
| CN | 204188033 | U | 3/2015 |
| CN | 104976820 | A | 10/2015 |
| CN | 105651081 | A | 6/2016 |
| JP | H102205251 | A | 8/1990 |
| JP | 2000154992 | A | 6/2000 |
| JP | 2009121728 | A | 6/2009 |
| JP | 2010169289 | A | 8/2010 |
| WO | 2015025365 | A1 | 2/2015 |
| WO | 2015148657 | A1 | 10/2015 |

OTHER PUBLICATIONS

First Office Action for Chinese Patent Application No. 201511027379.6 dated Apr. 20, 2017.

* cited by examiner

DOUBLE-ROW BENT HEAT EXCHANGER

CROSS-REFERENCE TO RELATED APPLICATIONS

The present application is a U.S. National Phase application under 35 USC § 371 of the International Patent Application No. PCT/CN2016/108738, filed on Dec. 6, 2016, which claims the benefit of prior Chinese Application No. 201511027379.6, filed with the State Intellectual Property Office of P. R. China on Dec. 30, 2015. The entire contents of the before-mentioned patent applications are incorporated by reference as part of the disclosure of this U.S. application.

BACKGROUND OF THE INVENTION

1. Field of the Invention

The present disclosure relates to a technical field of heat exchange, and more particularly to a double-row bent heat exchanger.

2. Description of the Related Art

In some application scenes, a parallel-flow heat exchanger, such as a micro-channel heat exchanger, needs to be bent around a transverse bending axis (parallel to a length direction of a flat tube) of the heat exchanger (i.e. a header of the heat exchanger is bent). The heat exchanger in the related art generally is bent in a single-row, as illustrated in FIG. 1. With requirements for increased heat-exchange capacity, a width of the flat tube and an outer diameter of the header of the single-row heat exchanger also increase. However, the large flat tube and header will result in a large bending radius, and the large bending radius will cause a great waste of space, such as the space in an air conditioner. An actual heat-exchange area of the heat exchanger will also be relatively reduced within a constant space, thereby resulting in a poor heat-exchange performance of the heat exchanger.

SUMMARY OF THE INVENTION

The present disclosure seeks to solve at least one of the problems existing in the related art to at least some extent. To this end, an aspect of the present disclosure provides a double-row bent heat exchanger. Under a condition of the same heat-exchange capacity, a diameter of a header of the heat exchanger is reduced, such that a bending radius of the heat exchanger is reduced, thereby effectively utilizing space and improving efficiency.

In order to achieve the above purposes, embodiments of a first aspect of the present disclosure provide a heat exchanger. The heat exchanger includes: a first header and a second header, a length of the second header being less than a length of the first header; flat tubes each being divided into a first straight segment connected to the first header, a second straight segment connected to the second header and a twisted segment connected between the first straight segment and the second straight segment, along a length direction of the flat tube; and fins disposed between adjacent first straight segments and between adjacent second straight segments. The flat tube is bent at the twisted segment around a first bending axis to provide a first bending portion, and the first bending axis is parallel to axial directions of the first header and the second header. The first header and the second header are bent around at least one second bending axis to provide at least one second bending portion, the first header is located at an outer bending side of the second bending portion and the second header is located at an inner bending side of the second bending portion, and the second bending axis is orthogonal to the axial directions of the first header and the second header and parallel to length directions of the first straight segment and the second straight segment.

Embodiments of a second aspect of the present disclosure provide a heat exchanger. The heat exchanger includes: a first header and at least two second headers, the at least two second headers being spaced apart from one another in axial directions thereof; flat tubes each divided into a first straight segment, a second straight segment and a twisted segment along a length direction of the flat tube, the twisted segment being connected between the first straight segment and the second straight segment, the first straight segments of the flat tubes being connected to the first header, and the second straight segments of at least a part of the flat tubes being connected to the at least two second headers; and fins disposed between adjacent first straight segments and between adjacent second straight segments. The flat tube is bent at the twisted segment around a first bending axis to provide a first bending portion, and the first bending axis is parallel to axial directions of the first header and the second header. The first header and the second header are bent around at least one second bending axis to provide at least one second bending portion, the first header is located at an outer bending side of the second bending portion and the second header is located at an inner bending side of the second bending portion, and the second bending axis is orthogonal to the axial directions of the first header and the second header and parallel to length directions of the first straight segment and the second straight segment.

Embodiments of a third aspect of the present disclosure provide a heat exchanger. The heat exchanger includes: at least two first headers spaced apart from one another in axial directions thereof; a second header; flat tubes each divided into a first straight segment, a second straight segment and a twisted segment along a length direction of the flat tube, the twisted segment being connected between the first straight segment and the second straight segment, the second straight segments of the flat tubes being connected to the second header, and the first straight segments of at least a part of the flat tubes being connected to the at least two first headers; and fins disposed between adjacent first straight segments and between adjacent second straight segments. The flat tube is bent at the twisted segment around a first bending axis to provide a first bending portion, and the first bending axis is parallel to axial directions of the first header and the second header. The first header and the second header are bent around at least one second bending axis to provide at least one second bending portion, the first header is located at an outer bending side of the second bending portion and the second header is located at an inner bending side of the second bending portion, and the second bending axis is orthogonal to the axial directions of the first header and the second header and parallel to length directions of the first straight segment and the second straight segment.

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
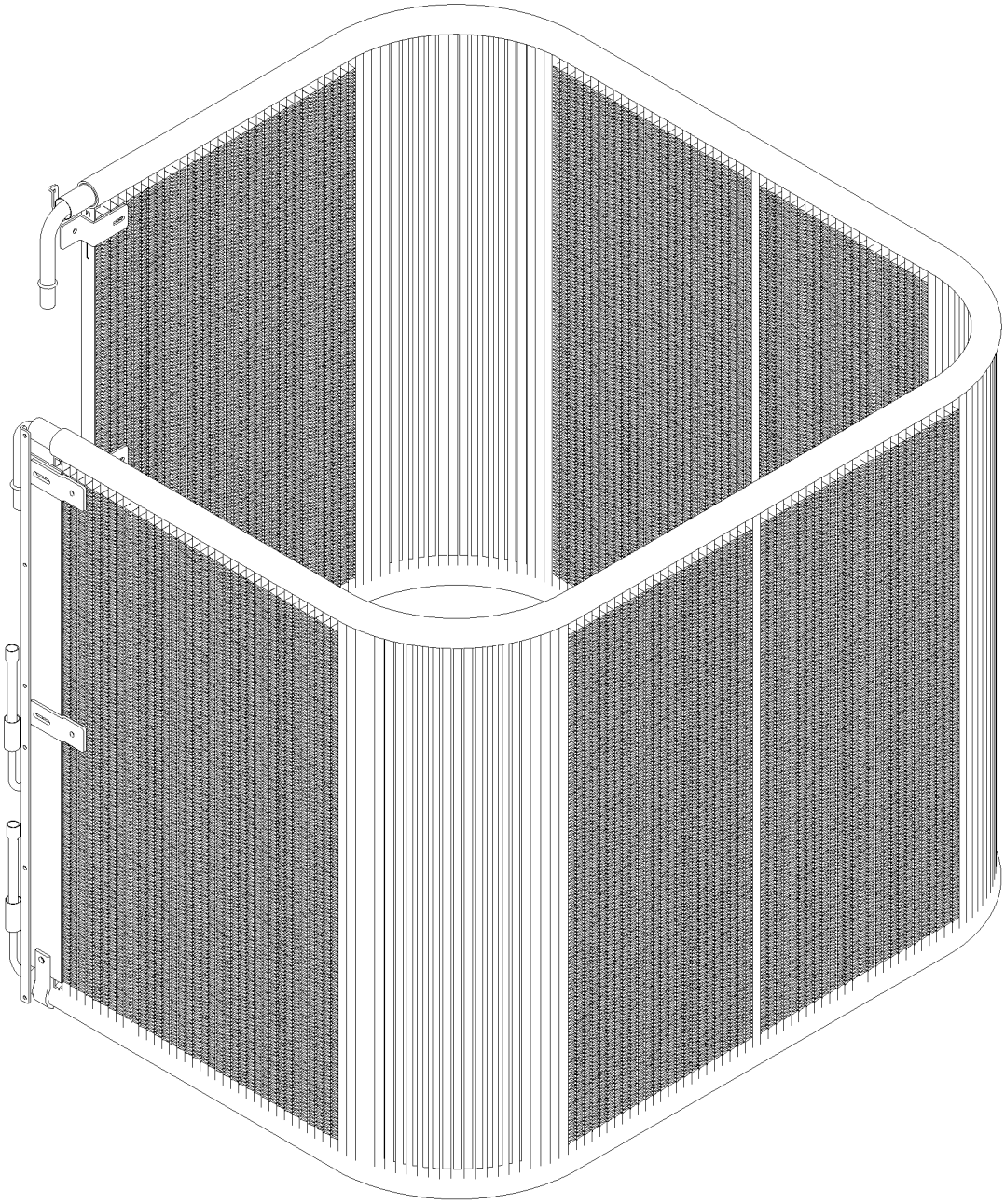
FIG. 1 is a perspective view of a single-row bent heat exchanger in the related art.

REFERENCE NUMERALS heat exchanger 1;

first header 10; second header 20; flat tube 30; first straight segment 31; second straight segment 32; twisted segment 33; fin 40; first bending portion 50; second bending portion 60; flat-tube positioner 70; flat-tube forming clamp roll 80;

first bending axis L; second bending axis K.

DETAILED DESCRIPTION OF THE INVENTION

Embodiments of the present disclosure will be described in detail below, and examples of the embodiments are shown in accompanying drawings. The embodiments described herein with reference to drawings are explanatory, illustrative, and used to generally understand the present disclosure. The embodiments shall not be construed to limit the present disclosure.

A double-row bent heat exchanger 1 according to embodiments of the present disclosure will be described with reference to drawings in the following.

As illustrated in FIGS. 2 to 7, the heat exchanger 1 according to embodiments of the present disclosure includes a first header 10, a second header 20, flat tubes 30 and fins 40.

A length of the second header 20 is less than that of the first header 10. The flat tube 30 is divided into a first straight segment 31, a second straight segment 32 and a twisted segment 33 along a length direction of the flat tube 30. The first straight segment 31 is connected to the first header 10, the second straight segment 32 is connected to the second header 20, and the twisted segment 33 is connected between the first straight segment 31 and the second straight segment 32. The fin 40 is disposed between adjacent first straight segments 31 and also between adjacent second straight segments 32.

The flat tube 30 is bent at the twisted segment 33 around a first bending axis L, so as to provide a first bending portion 50, and the first bending axis L is parallel to axial directions of the first header 10 and the second header 20. The first header 10 and the second header 20 are bent around at least one second bending axis K to provide at least one second bending portion 60. The first header 10 is located outside a bend at an outer bending side of the second bending portion 60 and the second header 20 is located at an inner bending side of the second bending portion 60. The second bending axis K is orthogonal to the axial direction of the first header 10 and the second header 20 and parallel to length directions of the first straight segment 31 and the second straight segment 32.

Figure 4:
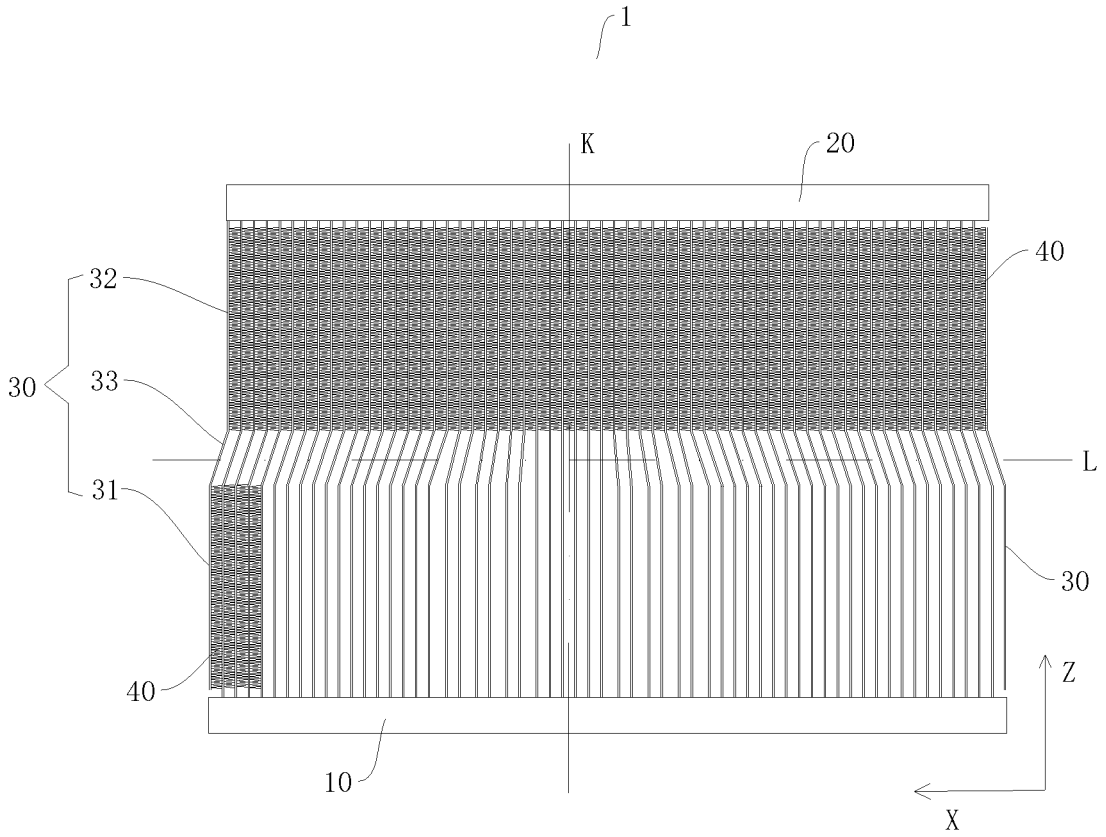
FIG. 4 is a schematic view of a heat exchanger before being bent according to an example of the present disclosure.
Figure 5:
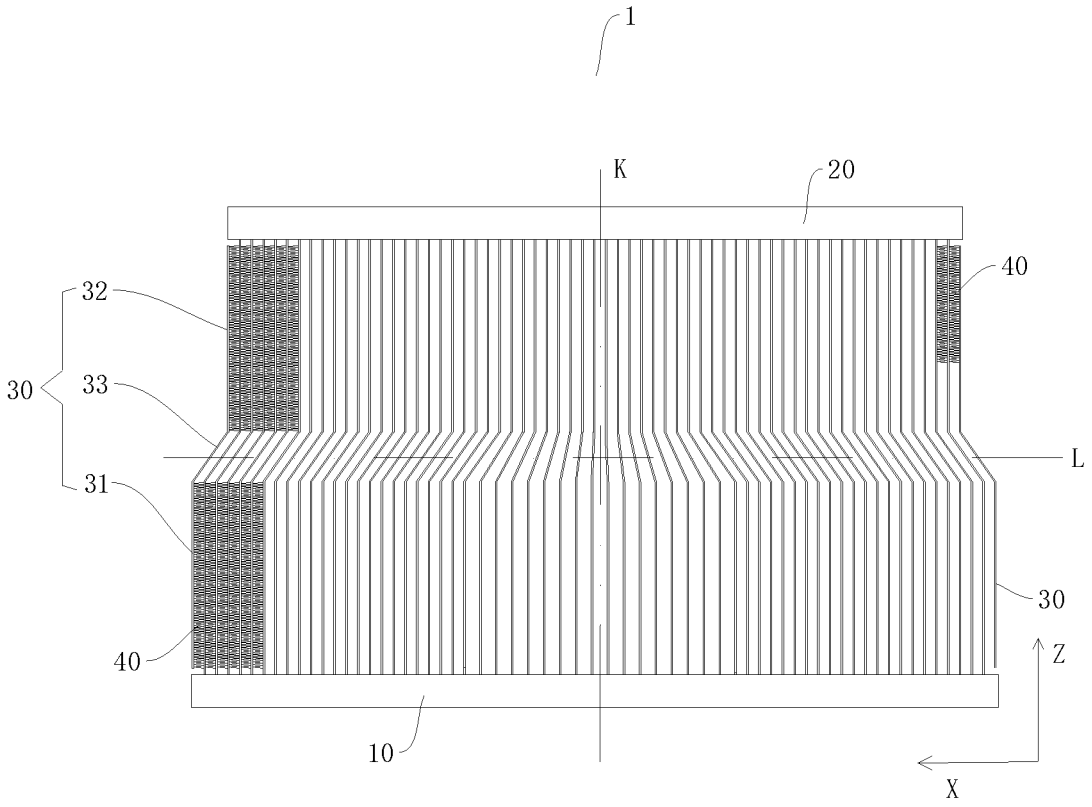
FIG. 5 is a schematic view of a heat exchanger before being bent according to another example of the present disclosure.
Figure 6:
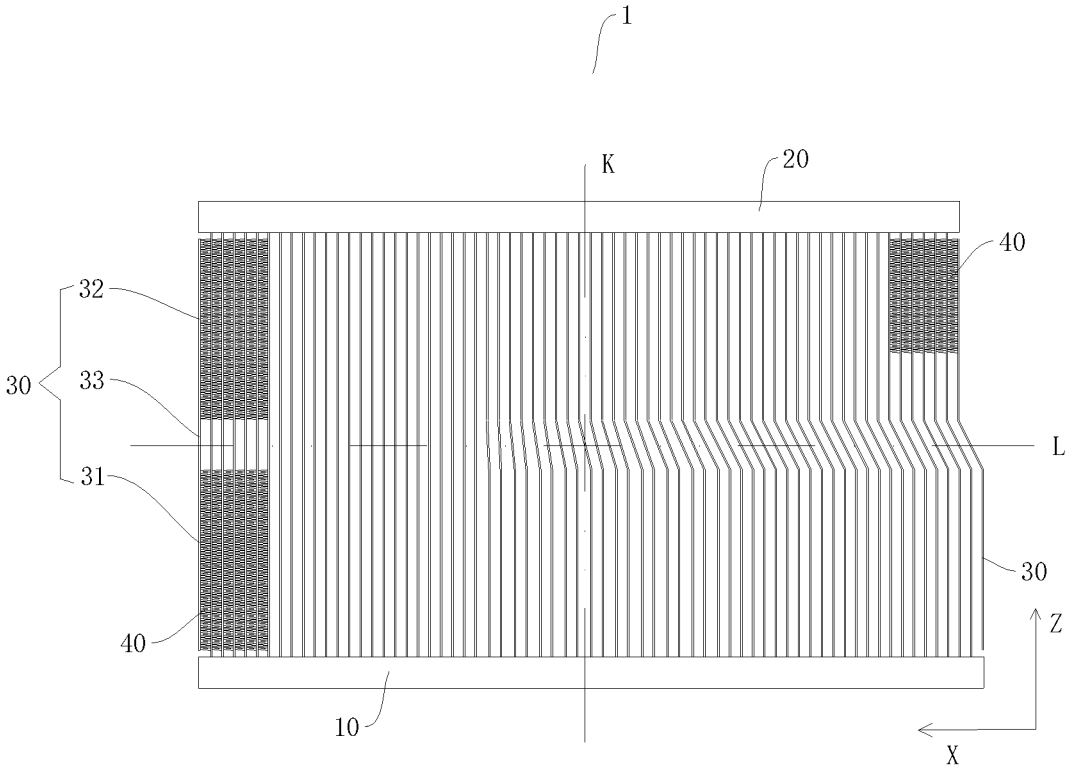
FIG. 6 is a schematic view of a heat exchanger before being bent according to still another embodiment of the present disclosure.
Figure 7:
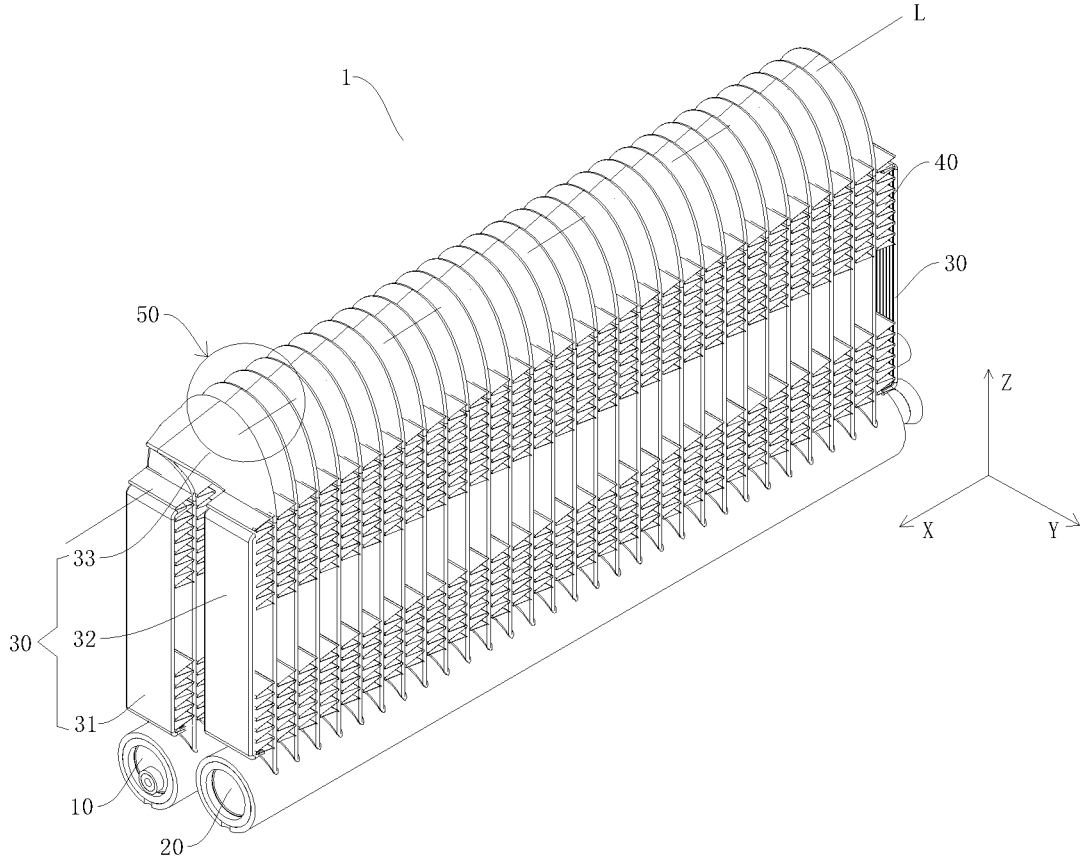
FIG. 7 is a schematic view of a heat exchanger after being bent around an axial direction of a header and before being bent around a length direction of a flat tube according to an embodiment of the present disclosure.
Figure 8:
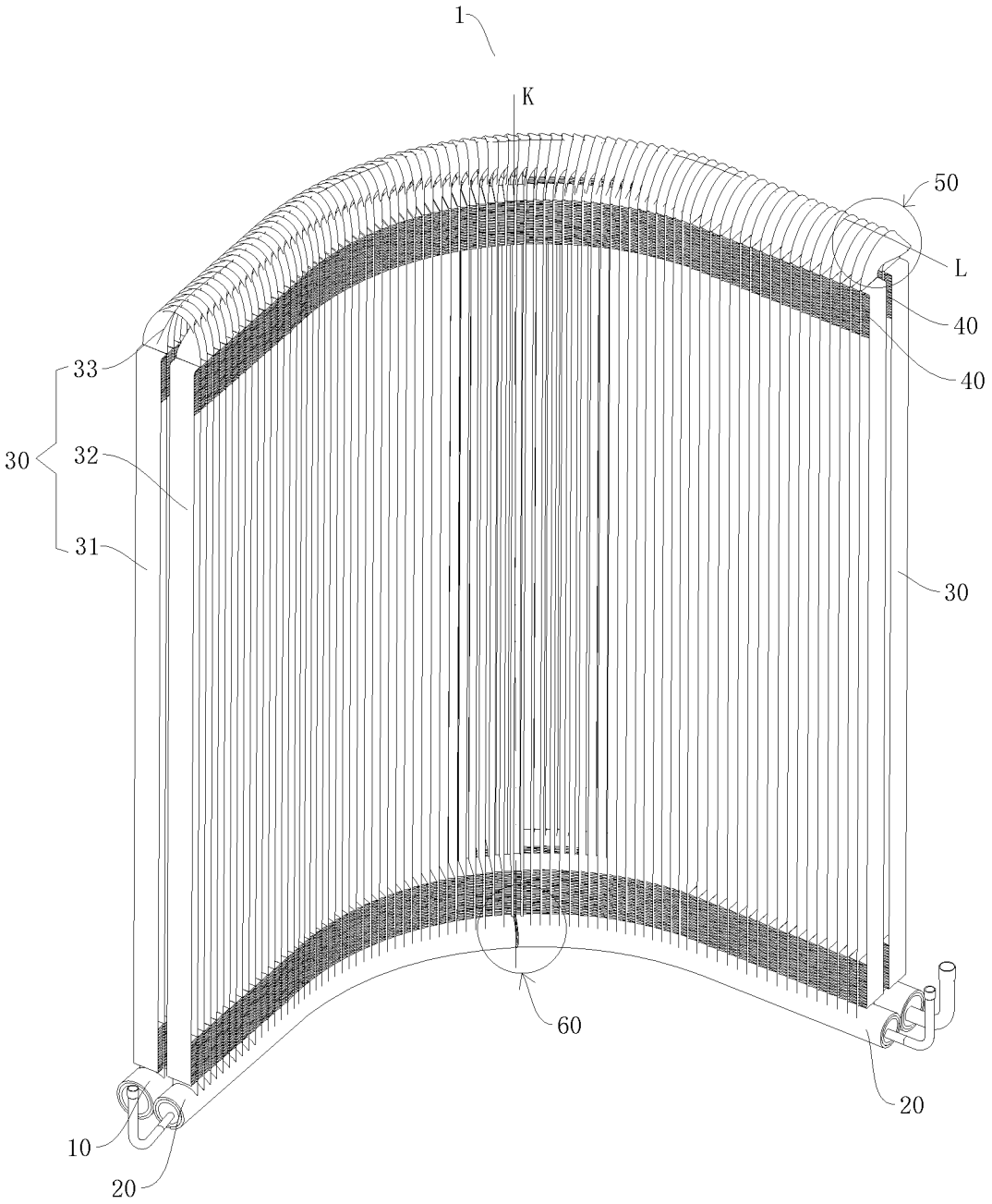
FIG. 8 is a perspective view of a heat exchanger according to another embodiment of the present disclosure.
Figure 9:
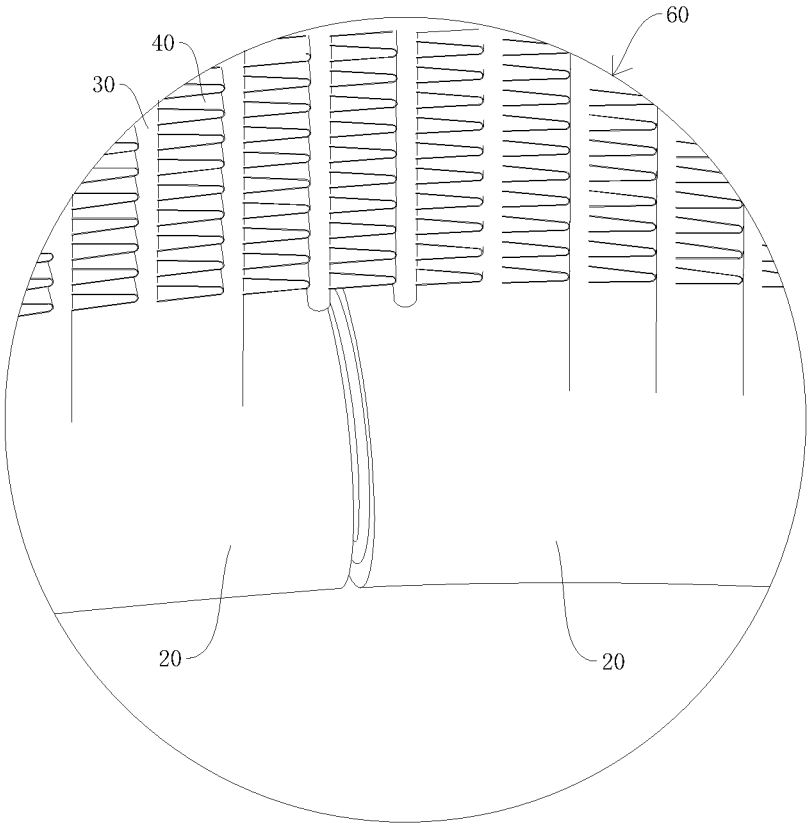
FIG. 9 is an enlarged view of a second bending portion in FIG. 8.

For example, FIGS. 4 to 7 illustrate an example in which one second bending portion 60 is provided. FIGS. 4 to 6 illustrate the heat exchanger 1 before being bent, a direction X indicates the axial directions of the first header 10 and the second header 20 before being bent, a direction Y indicates a width direction of the flat tube 30, and a direction Z indicates the length direction of the flat tube 30.

The first bending axis L extends in the X direction, and may be located at a center of the flat tube 30 in the Z direction. The second bending axis K extends in the Z direction, and may be located at centers of first header 10 and the second header 20 in the X direction. Before the heat exchanger 1 is bent around the first bending axis L, the first header 10 and the second header 20 are spaced apart in the Z direction, while after the heat exchanger 1 is bent around the first bending axis L, the first header 10 and the second header 20 are arranged in the Y direction. Before the heat exchanger 1 is bent around the second bending axis K, distances between respective adjacent flat tubes 30 are equal to or unequal to one another, while after the heat exchanger 1 is bent around the second bending axis K, the distances between the respective adjacent flat tubes 30 will change with the bending of the first header 10 and the second header 20, and the distances between the respective adjacent flat tubes 30 are still equal to or unequal to one another.

In the heat exchanger 1 according to embodiments of the present disclosure, the flat tube 30 is bent around the first bending axis L into two rows, and the first header 10 and the second header 20 are bent around the at least one second bending axis K, thereby providing a double-row bent structure. Thus, under the same heat-exchange capacity, diameters of the first header 10 and the second header 20 are reduced, such that a bending radius of the heat exchanger 1 around the second bending axis K is dramatically reduced, space utilization of the heat exchanger 1 is improved, and a bending area of the heat exchanger 1 is increased, thereby resulting in high energy efficiency.

Furthermore, the length of the second header 20 is less than the length of the first header 10. After the flat tube 30 is bent around the first bending axis L and the first header 10 and the second header 20 are bent around the second bending axis K, the first header 10 is positioned outside the second header 20, such that two ends of the first header 10 can be aligned with two ends of the second header 20 correspondingly, so as to prevent the heat exchanger 1 from being damaged due to deformation and twist, and also to avoid leakage of the heat exchanger 1, thus ensuring pressure and service life thereof.

For example, the heat exchanger 1 according to embodiments of the present disclosure may be applied to an air conditioning unit. In some application environments, when the air conditioning unit has a relatively small size, the heat exchanger 1 according to embodiments of the present disclosure facilitates connection of pipes, and can achieve a double length of the flat tube under the same height of a core, such that a flow path of a refrigerant is increased to allow a full heat exchange of the refrigerant. In addition, the heat exchanger 1 increases the heat-exchange area, improves a flow velocity of the refrigerant in the flat tube 30, enhances a heat exchange coefficient on the refrigerant side, and hence improves the heat-exchange performance.

In general, for the heat exchanger 1 according to embodiments of the present disclosure, under a condition of the same heat-exchange capacity, a diameter of the header is reduced, such that the bending radius of the heat exchanger is reduced, thereby effectively utilizing space and improving efficiency.

A heat exchanger 1 according to a specific embodiment of the present disclosure will be described with reference to drawings in the following.

As illustrated in FIGS. 2 to 7, the heat exchanger 1 according to embodiments of the present disclosure includes the first header 10, the second header 20, the flat tubes 30 and the fins 40.

Specifically, as illustrated in FIGS. 4 and 5, a center of the first header 10 in the axial direction thereof and a center of the second header 20 in the axial direction thereof are aligned with each other in the Z direction. The first straight segment 31 located at an outermost side of the heat exchanger 1 and the second straight segment 32 located at the outermost side of the heat exchanger 1 are staggered in a direction orthogonal to the axial directions of the first header 10 and the second header 20 and parallel to the length directions of the first straight segment 31 and the second straight segment 32, before the heat exchanger 1 is bent around the first bending axis L and the second bending axis K.

For example, as illustrated in FIG. 4, before the bending around the first bending axis L and the second bending axis K, among the flat tubes 30, a part of the flat tubes 30 located on a left side in FIG. 4 and another part of the flat tubes 30 located on a right side in FIG. 4 each have the first straight segment 31 and the second straight segment 32 staggered in the Z direction. In other words, the twisted segments 33 of those flat tubes 30 extend obliquely relative to the Z direction before being twisted. However, the twisted segments 33 of the flat tubes 30 located in a middle portion in FIG. 4 extend in the Z direction before being twisted.

As illustrated in FIG. 5, before the bending around the first bending axis L and the second bending axis K, the first straight segment 31 and the second straight segment 32 of each of the flat tubes 30 are staggered in the Z direction.

Thus, the first header 10 and the second header 20 may have the same number of flat tube-grooves, and thus correspond to the same number of flat tubes 30.

Figure 2:
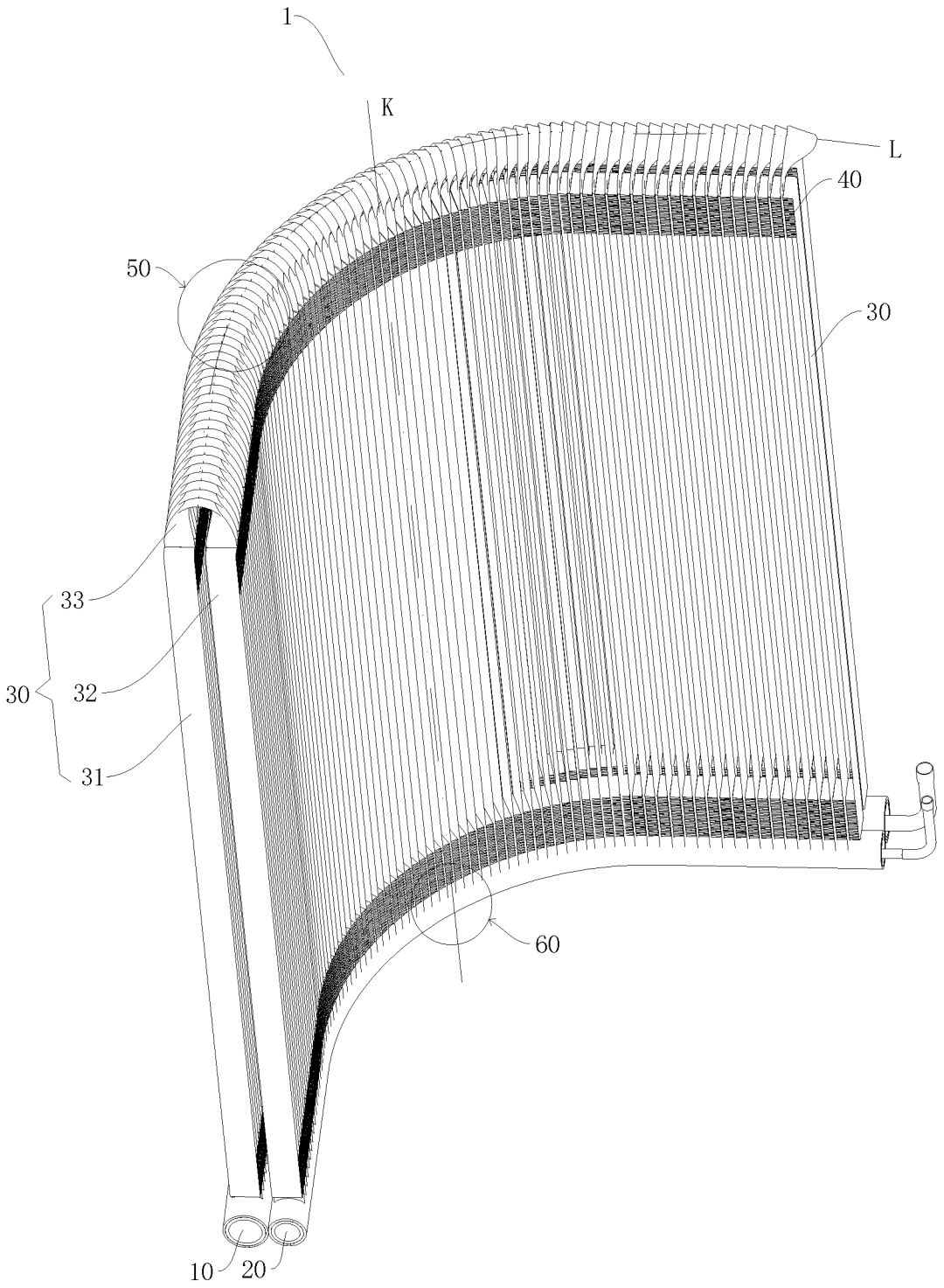
FIG. 2 is a perspective view of a heat exchanger according to an embodiment of the present disclosure.
Figure 3:
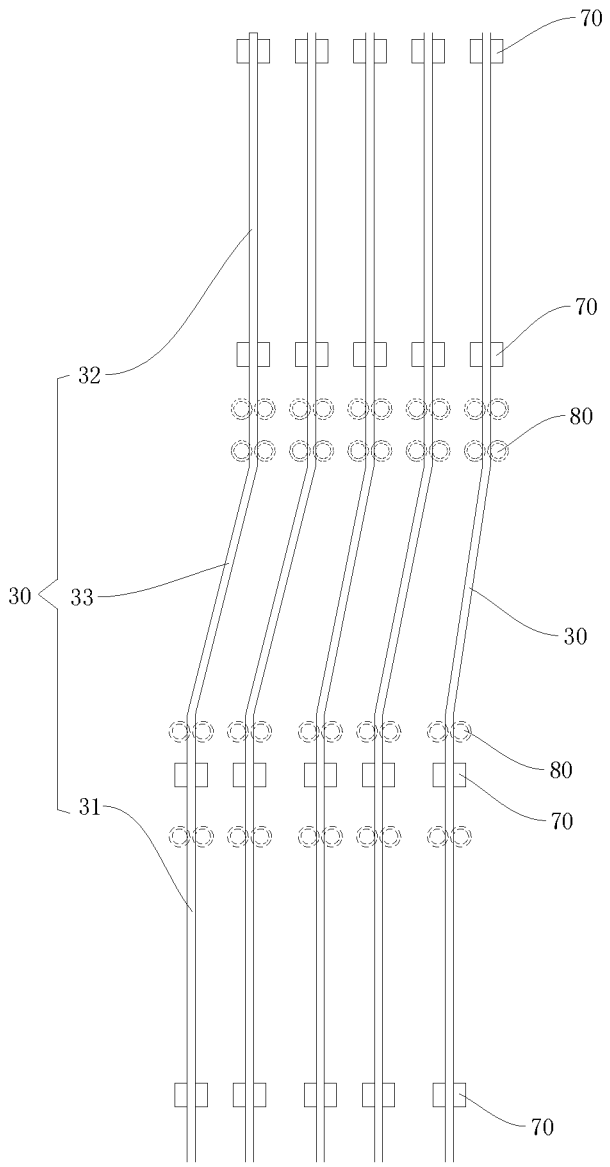
FIG. 3 is a schematic view illustrating a processing of a flat tube of a heat exchanger according to an embodiment of the present disclosure.

Specifically, as illustrated in FIG. 2, the flat tube 30 is formed prior to assembling. The first straight segment 31 and the second straight segment 32 are allowed to be staggered in the Z direction by a flat-tube positioner 70 and a flat-tube forming clamp roll 80, so as to make a portion between the first straight segment 31 and the second straight segment 32 inclined relative to the Z direction, and then the inclined portion is twisted to form the twisted segment 33. The fins 40 employ different heights, and hence kinds of a pre-bending of the flat tubes 30 may be reduced, thereby reducing kinds of parts.

According to some specific embodiments of the present disclosure, as illustrated in FIG. 6, the first straight segment 31 located at a first outermost side of the heat exchanger 1 and the second straight segment 32 located at the first outermost side of the heat exchanger 1 are aligned with each other in the direction orthogonal to the axial directions of the first header 10 and the second header 20 and parallel to the length directions of the first straight segment 31 and the second straight segment 32, and the first straight segment 31 located at a second outermost side of the heat exchanger 1 and the second straight segment 32 located at the second outermost side of the heat exchanger 1 are staggered in the direction orthogonal to the axial directions of the first header 10 and the second header 20 and parallel to the length directions of the first straight segment 31 and the second straight segment 32, before the bending around the first bending axis L and the second bending axis K.

For example, as illustrated in FIG. 6, before the bending around the first bending axis L and the second bending axis K, the leftmost side of the heat exchanger 1 in FIG. 6 is the first outermost side, and the rightmost side of the heat exchanger 1 in FIG. 6 is the second outermost side. A part of the flat tubes 30 located on the left side in FIG. 6 have the first straight segment 31 and the second straight segment 32 aligned in the Z direction. That is, the twisted segments 33 of these flat tubes 30 extend in the Z direction before being twisted. Another part of the flat tubes 30 located on the right side in FIG. 6 have the first straight segment 31 and the second straight segment 32 staggered in the Z direction. That is, the twisted segments 33 of these flat tubes 30 extend obliquely relative to the Z direction before being twisted.

A manufacturing method for the double-row bent heat exchanger according to embodiments of the present disclosure will be described in the following.

The manufacturing method includes the following steps.

A first header and a second header are provided, and a length of the second header is less than a length of the first header.

Flat tubes each are twisted around a twisting axis parallel to a length direction of the flat tube so as to divide the flat tube into a first straight segment, a second straight segment and a twisted segment connected between the first straight segment and the second straight segment.

The flat tube is bent at the twisted segment around a first bending axis parallel to thickness directions of the first straight segment and the second straight segment so as to provide a first bending portion.

The first straight segment is connected with the first header, and the second straight segment is connected with the second header.

Fins are provided between adjacent first straight segments and between adjacent second straight segments.

The first header and the second header are bent around at least one second bending axis to provide at least one second bending portion. The first header is located at an outer bending side of the second bending portion and the second header is located at an inner bending side of the second bending portion. The second bending axis is orthogonal to axial directions of the first header and the second header and parallel to length directions of the first straight segment and the second straight segment.

In the manufacturing method for the heat exchanger according to embodiments of the present disclosure, the flat tube is first bent around the first bending axis into two rows, and then the first header and the second header are bent around the at least one second bending axis, thereby providing a double-row bent structure. Thus, under the same heat-exchange capacity, diameters of the first header and the second header are reduced, such that a bending radius of the heat exchanger around the second bending axis is dramatically reduced, space utilization of the heat exchanger is improved, and a bending area of the heat exchanger is increased, thereby resulting in high energy efficiency.

Furthermore, the length of the second header is less than the length of the first header, and after the bending, the first header is positioned outside the second header, such that two ends of the first header can be aligned with two ends of the second header correspondingly, so as to prevent the heat exchanger from being damaged due to deformation and twist, and also to avoid leakage of the heat exchanger, thus ensuring pressure and service life thereof.

In general, with the manufacturing method for the heat exchanger according to embodiments of the present disclosure, under the condition of the same heat-exchange capacity, the diameter of the header can be reduced, such that the bending radius of the heat exchanger is reduced, thereby effectively utilizing the space and improving the efficiency.

In some specific embodiments of the present disclosure, the first straight segment and the second straight segment of at least a part of the flat tubes are staggered in the length directions of the first straight segment and the second straight segment, before the bending around the first bending axis and the second bending axis. Thus, the first header and the second header may have the same number of flat-tube grooves, and thus correspond to the same number of flat tubes.

A double-row bent heat exchanger 1 according to other embodiments of the present disclosure will be described with reference to drawings in the following.

As illustrated in FIGS. 8 to 13, the heat exchanger 1 according to embodiments of the present disclosure includes a first header 10, at least two second headers 20, flat tubes 30 and fins 40.

The at least two second headers 20 are spaced apart from one another along axial directions of the second headers 20. The flat tube 30 is divided into a first straight segment 31, a second straight segment 32 and a twisted segment 33 along a length direction of the flat tube, and the twisted segment 33 is connected between the first straight segment 31 and the second straight segment 32. The first straight segments 31 of the flat tubes 30 are connected to the first header 10, and the second straight segments 32 of at least a part of the flat tubes 30 are connected to the at least two second headers 20. The fins 40 are provided between adjacent first straight segments 31 and also between adjacent second straight segments 32.

The flat tube 30 is bent at the twisted segment 33 around a first bending axis L so as to provide a first bending portion 50, and the first bending axis L is parallel to the axial directions of the first header 10 and the second header 20. The first header 10 and the second header 20 are bent around at least one second bending axis K to provide at least one second bending portion 60. The first header 10 is located at an outer bending side of the second bending portion 60 and the second header 20 is located at an inner bending side of the second bending portion 60. The second bending axis K is orthogonal to the axial directions of the first header 10 and the second header 20 and parallel to the length directions of the first straight segment 31 and the second straight segment 32.

Figure 10:
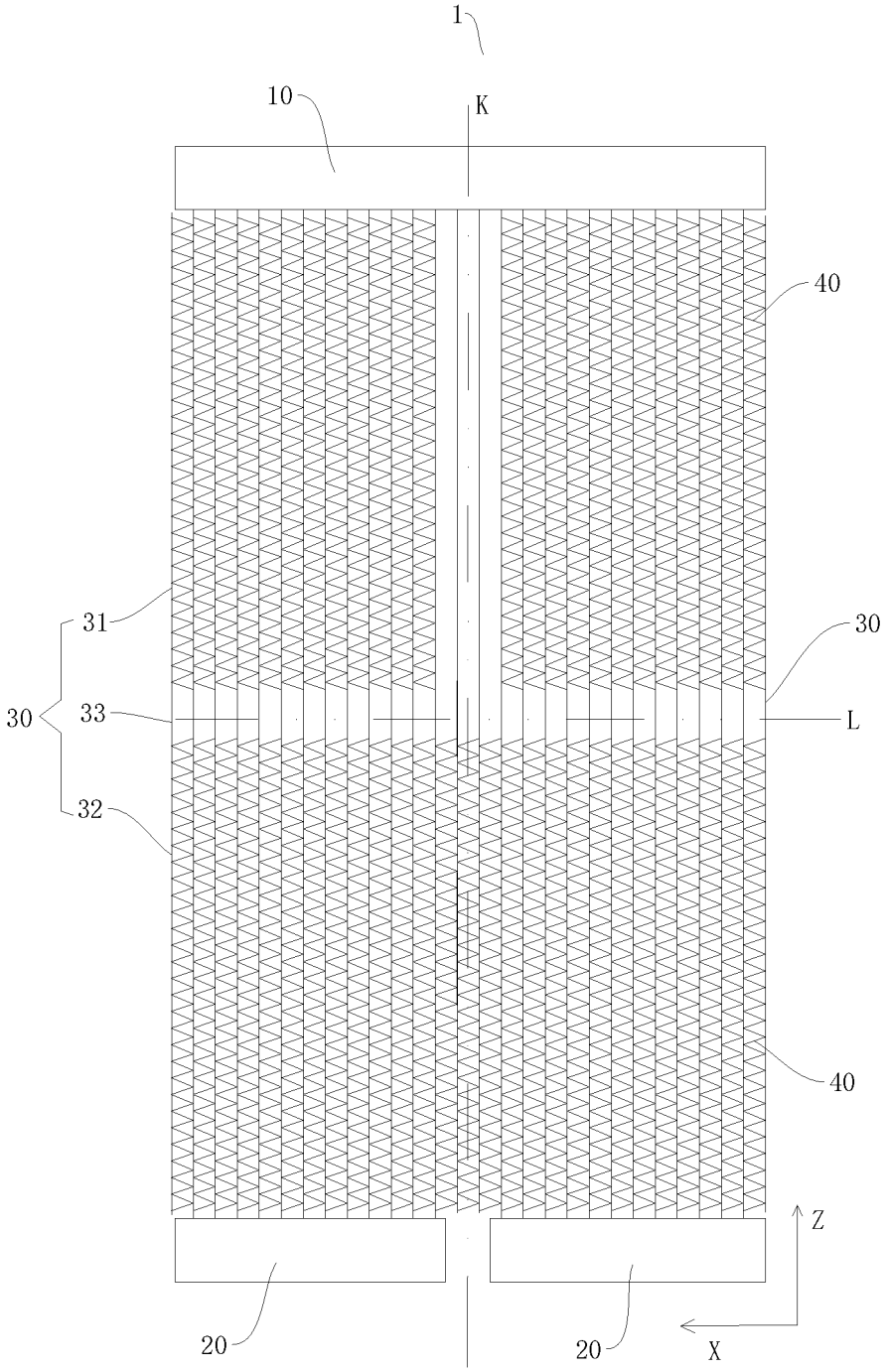
FIG. 10 is a schematic view of a heat exchanger before being bent according to an example of the present disclosure.
Figure 11:
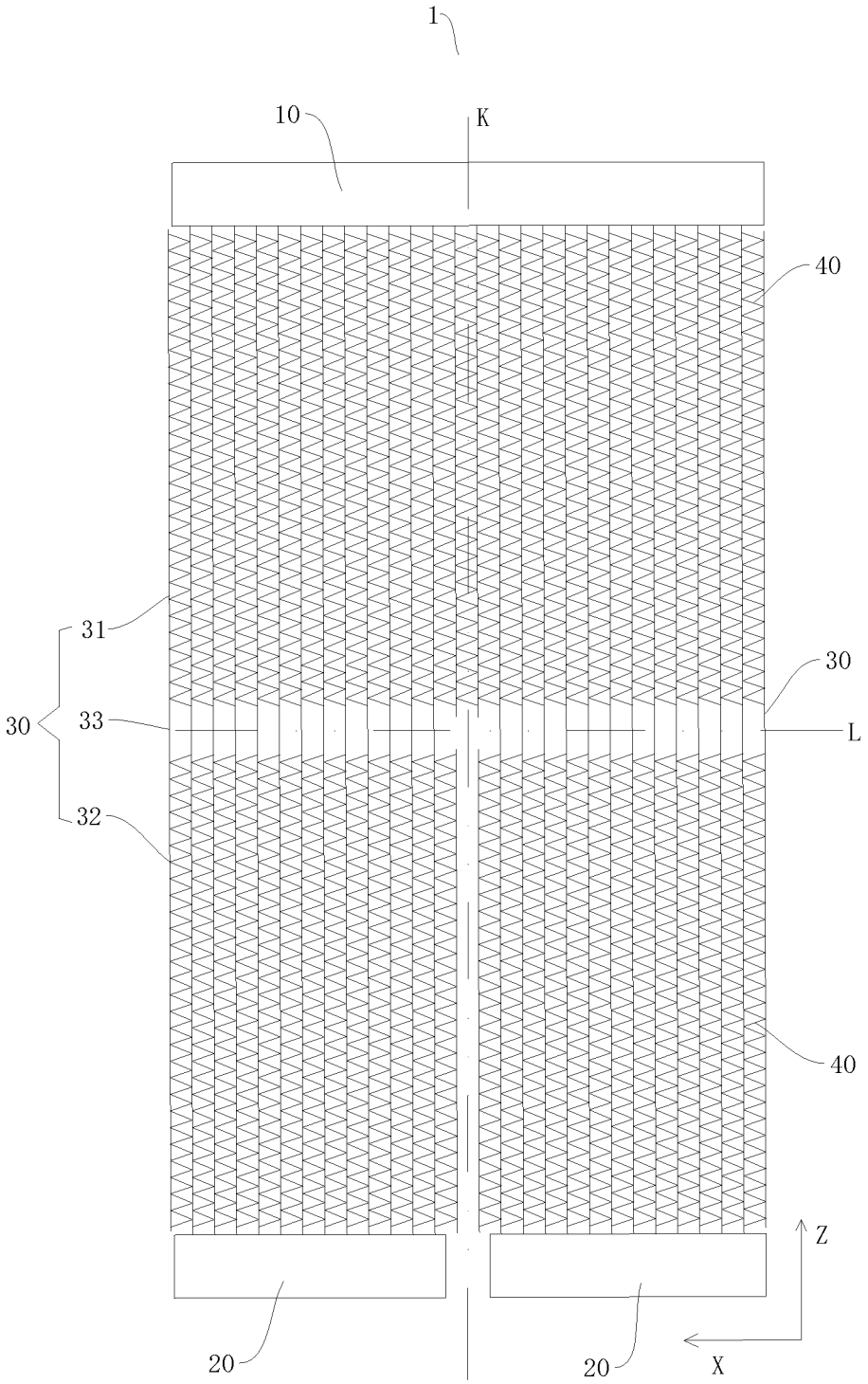
FIG. 11 is a schematic view of a heat exchanger before being bent according to another example of the present disclosure.
Figure 12:
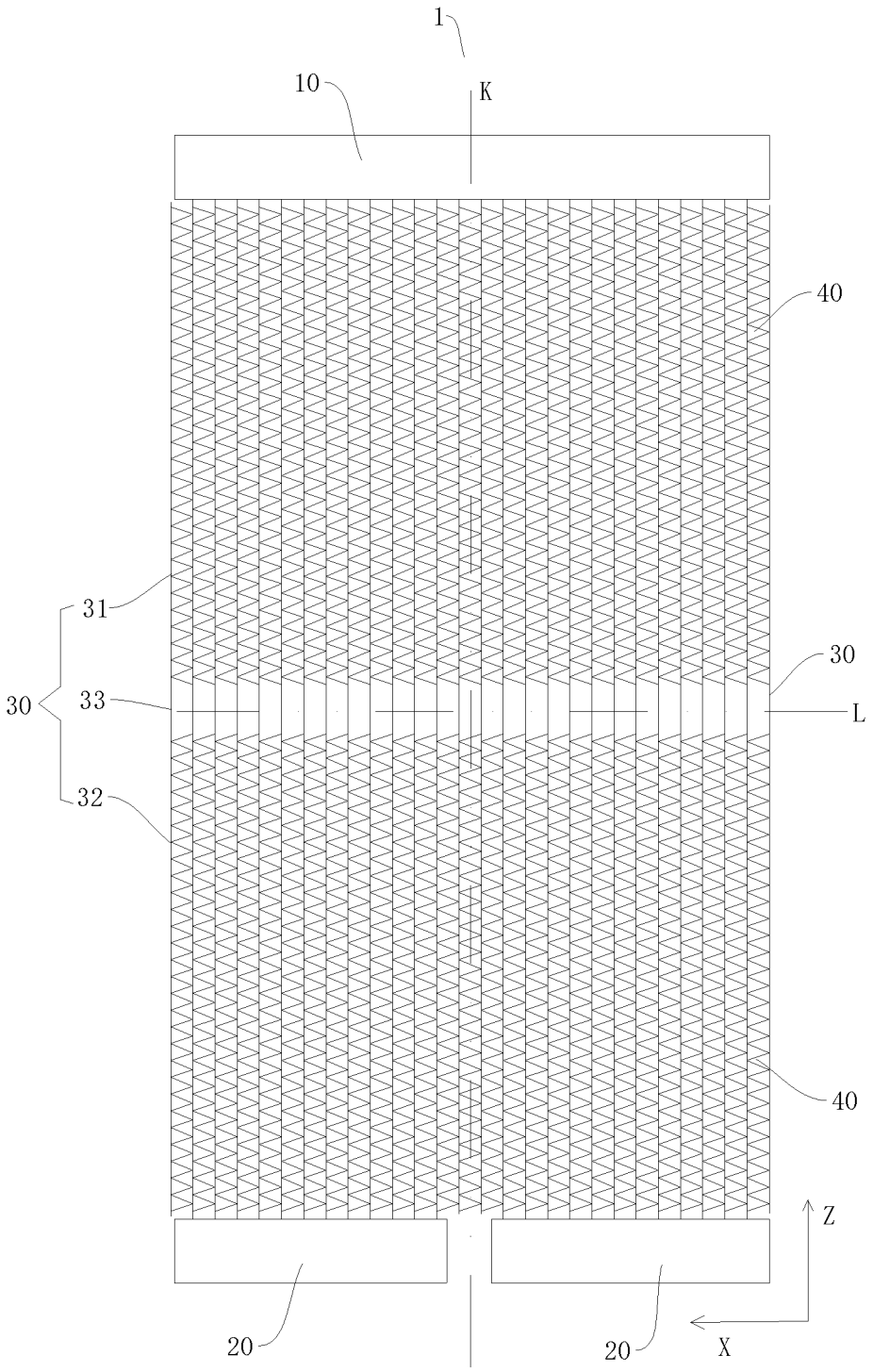
FIG. 12 is a schematic view of a heat exchanger before being bent according to still another embodiment of the present disclosure.

For example, FIGS. 8 to 12 illustrate an example in which two second headers 20 and one second bending portion 60 are provided. FIGS. 10 to 12 illustrate the heat exchanger 1 before being bent. A direction X indicates the axial directions of the first header 10 and the second header 20 before being bent, and a direction Z indicates a length direction of the flat tube 30.

The first bending axis L extends in the X direction, and may be located at a center of the flat tube 30 in the Z direction. The second bending axis K extends in the Z direction, and may be located at a center of first header 10 in the X direction, and the second bending axis K passes through a gap between the two second headers 20. Before the heat exchanger 1 is bent around the first bending axis L, the first header 10 and the second header 20 are spaced apart in the Z direction, while after the heat exchanger 1 is bent around the first bending axis L, the first header 10 and the second header 20 are arranged in a width direction of the flat tube 30. Before the heat exchanger 1 is bent around the second bending axis K, distances between respective adjacent flat tubes 30 are equal to or unequal to one another, while after the heat exchanger 1 is bent around the second bending axis K, the distances between the respective adjacent flat tubes 30 will change with the bending of the first header 10 and the second header 20, and the distances between the respective adjacent flat tubes 30 are still equal to or unequal to one another.

In the heat exchanger 1 according to embodiments of the present disclosure, the flat tube 30 is bent around the first bending axis L into two rows, and the first header 10 and the second header 20 are bent around the at least one second bending axis K, thereby providing a double-row bent structure. Thus, under the same heat-exchange capacity, diameters of the first header 10 and the second header 20 are reduced, such that a bending radius of the heat exchanger 1 around the second bending axis K is dramatically reduced, space utilization of the heat exchanger 1 is improved, and a bending area of the heat exchanger 1 is increased, thereby resulting in high energy efficiency.

Furthermore, since a plurality of second headers 20 are provided and spaced apart in the axial directions of the second headers 20, after the bending around the second bending axis K, the gap between the second headers 20 is deformed for self-adaptation during the bending, such that two ends of the first header 10 can be aligned with ends of the two second headers 20 located at the outermost side correspondingly, so as to prevent the heat exchanger 1 from being damaged due to deformation and twist, and also to avoid leakage of the heat exchanger 1, thus ensuring pressure and service life thereof. Moreover, during the bending around the second bending axis K, the adjacent second headers 20 approach to each other in a bent and extruded state, such that air leak is effectively avoided, so as not to affect the heat-exchange performance. Additionally, the plurality of second headers 20 is provided such that an internal wastage of the heat-exchange capacity, due to a temperature difference between the refrigerants in adjacent chambers of the same header, can be prevented.

In general, in the heat exchanger 1 according to embodiments of the present disclosure, under a condition of the same heat-exchange capacity, the diameter of the header is reduced, such that the bending radius of the heat exchanger is reduced, thereby effectively utilizing the space, reducing the internal wastage of the heat-exchange capacity and improving the efficiency.

A double-row bent heat exchanger 1 according to a specific embodiment of the present disclosure will be described with reference to drawings in the following.

As illustrated in FIGS. 8 to 13, the heat exchanger 1 according to embodiments of the present disclosure includes the first header 10, the at least two second headers 20, the flat tubes 30 and the fins 40.

Optionally, as illustrated in FIGS. 10 to 12, the second straight segments 32 of a part of the flat tubes 30 are connected to the at least two second headers 20, and the rest part of the flat tubes 30 corresponding to the gap between adjacent second headers 20 each are a blind tube. The twisted segment of the blind tube is removed before the blind tube is bent. No fin 40 is provided between the first straight segments 31 of the blind tubes, and/or no fin 40 is provided between the second straight segments 32 of the blind tubes.

For example, a case in which two second headers 20 and one second bending portion 60 are provided is taken as an example. The first straight segments 31 of the flat tubes 30 are connected to the first straight segment 10 separately. However, the second straight segments 32 of the flat tubes 30 may be all connected to the second header 20, in which case the gap between the two second headers 20 corresponds to a gap of a group of two adjacent flat tubes 30. Or, a part of the second straight segments 32 of the flat tubes 30 may be connected to the second header 20, in which case the flat tubes 20 corresponding to the gap between the two second headers 20 each are a blind tube.

For the flat tubes 30 corresponding to the gap between the two second headers, the fin 40 between the second straight segments 32 thereof may be a retractable doubled fin (as illustrated in FIGS. 10 and 12), or no fin is provided between the second straight segments 32 thereof (as illustrated in FIG. 11); the fin 40 between the first straight segments 31 thereof may be a retractable doubled fin (as illustrated in FIGS. 11 and 12), or no fin is provided between the first straight segments 31 thereof (as illustrated in FIG. 10).

Optionally, by setting the distribution of an inlet and an outlet in the first header 10 and the plurality of second headers 20, the heat exchanger 1 can be configured as a multi-flow heat exchanger or a single-flow heat exchanger. It can be appreciated by those skilled in the art that, the single-flow heat exchanger means that a heat-exchange medium flows from one of the first header 10 and the second header 20 into the other one of the first header 10 and the second header 20 through the flat tubes 30, and flows out of the heat exchanger 1 through the other one of the first header 10 and the second header 20. The multi-flow heat exchanger means that the heat-exchange medium flows between the first header 10 and the second header 20 through the flat tubes 30 in a reciprocating manner before flowing out of the heat exchanger 1.

Preferably, the heat exchanger 1 is the multi-flow heat exchanger, such that the heat-exchange performance can be effectively adjusted to reach an optimized heat-exchange performance.

Figure 13:
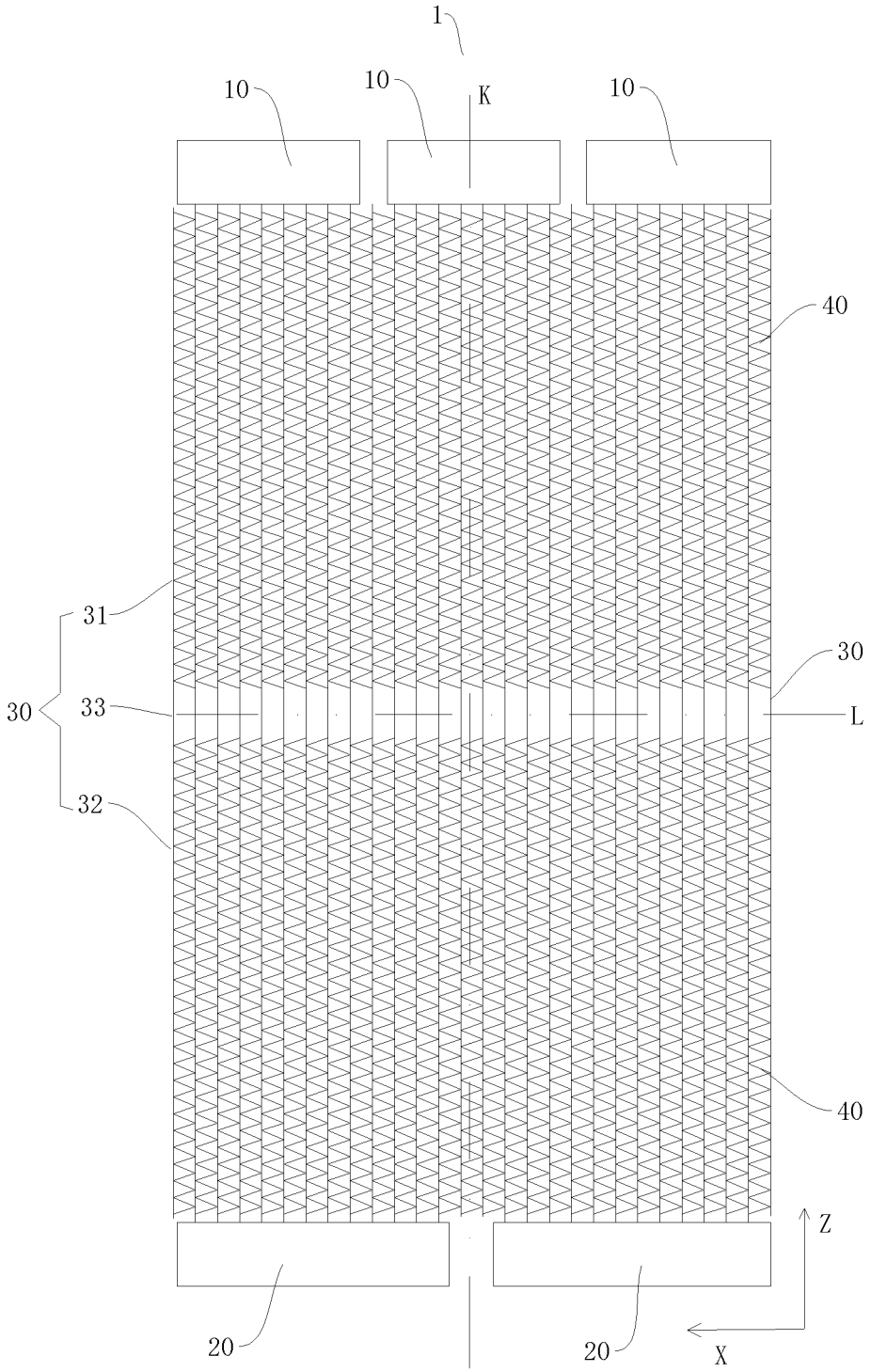
FIG. 13 is a schematic view of a heat exchanger before being bent according to a further embodiment of the present disclosure.

In some specific embodiments of the present disclosure, as illustrated in FIG. 13, a plurality of first headers 10 are provided, and the plurality of first headers 10 are spaced apart from one another in the axial directions thereof. Before the bending around the first bending axis L and the second bending axis K, the gap between the first headers 10 and the gap between the second headers 20 are staggered in the axial directions of the first header 10 and the second header 20 (i.e. the X direction). Thus, a capacity of deformation for self-adaptation of the heat exchanger 1 during the bending around the second bending axis K can be further improved, thereby further ensuring the pressure and the service life of the heat exchanger 1.

A manufacturing method for the double-row bent heat exchanger according to embodiments of the present disclosure will be described with reference to drawings in the following.

The manufacturing method for the heat exchanger includes the following steps.

A first header and at least two second headers are provided, and the at least two second headers are spaced apart from one another along axial directions thereof.

Flat tubes each are twisted around a twisting axis parallel to a length direction of the flat tube so as to divide the flat tube into a first straight segment, a second straight segment and a twisted segment connected between the first straight segment and the second straight segment.

Flat tubes each are bent at the twisted segment around a first bending axis parallel to thickness directions of the first straight segment and the second straight segment, so as to provide a first bending portion.

The first straight segments of the flat tubes are connected with the first header, and the second straight segments of at least a part of the flat tubes are connected with the at least two second headers. Fins are arranged between adjacent first straight segments and also between adjacent second straight segments.

The first header and the second header are bent around at least one second bending axis to provide at least one second bending portion. The first header is located at an outer bending side of the second bending portion and the second header is located at an inner bending side of the second bending portion. The second bending axis is orthogonal to axial directions of the first header and the second header and parallel to length directions of the first straight segment and the second straight segment.

In the heat exchanger according to embodiments of the present disclosure, the flat tube is first bent around the first bending axis into two rows, and then the first header and the second header are bent around the at least one second bending axis, thereby providing a double-row bent structure. Thus, under the same heat-exchange capacity, diameters of the first header and the second header are reduced, such that a bending radius of the heat exchanger around the second bending axis is dramatically reduced, space utilization of the heat exchanger is improved, and a bending area of the heat exchanger is increased, thus resulting in high energy efficiency.

Furthermore, since at least two second headers are provided and spaced apart in the axial direction thereof, after the bending around the second bending axis K, the gap between the second headers is deformed for self-adaptation during the bending, such that two ends of the first header can be aligned with ends of the two second headers located at the outermost side correspondingly, so as to prevent the heat exchanger 1 from being damaged due to deformation and twist, and also to avoid the leakage of the heat exchanger, thus ensuring the pressure and the service life thereof. Moreover, during the bending around the second bending axis, the adjacent second headers approach to each other in a bent and extruded state, such that air leak is effectively prevented, so as not to affect the heat-exchange performance. Additionally, the plurality of second headers is provided such that an internal wastage of the heat-exchange capacity, due to a temperature difference between the refrigerants in adjacent chambers of the same header, can be prevented.

In general, in the manufacturing method for the heat exchanger according to embodiments of the present disclosure, under a condition of the same heat-exchange capacity, the diameter of the header of the heat exchanger can be reduced, such that the bending radius of the heat exchanger is reduced, thereby effectively utilizing the space, reducing the internal wastage of the heat-exchange capacity and improving the efficiency.

In some specific embodiments of the present disclosure, the second straight segments of a part of the flat tubes are connected to the at least two second headers, and the rest part of the flat tubes corresponding to the gap between adjacent second headers each are a blind tube. No fin is provided between the first straight segments of the blind tubes, and/or no fin is provided between the second straight segments of the blind tubes. Thus, the heat exchanger 1 can be configured as the multi-flow heat exchanger, such that the heat-exchange performance can be effectively adjusted to reach an optimized heat-exchange performance.

Further, a plurality of the first headers are provided, and the plurality of the first headers are spaced apart from one another along the axial directions thereof. Before the bending around the first bending axis and the second bending axis, the gap between the first headers and the gap between the second headers are staggered in the axial direction of the first header and the axial direction of the second header. Thus, the capacity of deformation for self-adaptation of the heat exchanger during the bending around the second bending axis can be further improved, thereby further ensuring the pressure and the service life of the heat exchanger.

A double-row bent heat exchanger 1 according to other embodiments of the present disclosure will be described with reference to drawings in the following.

Figure 14:
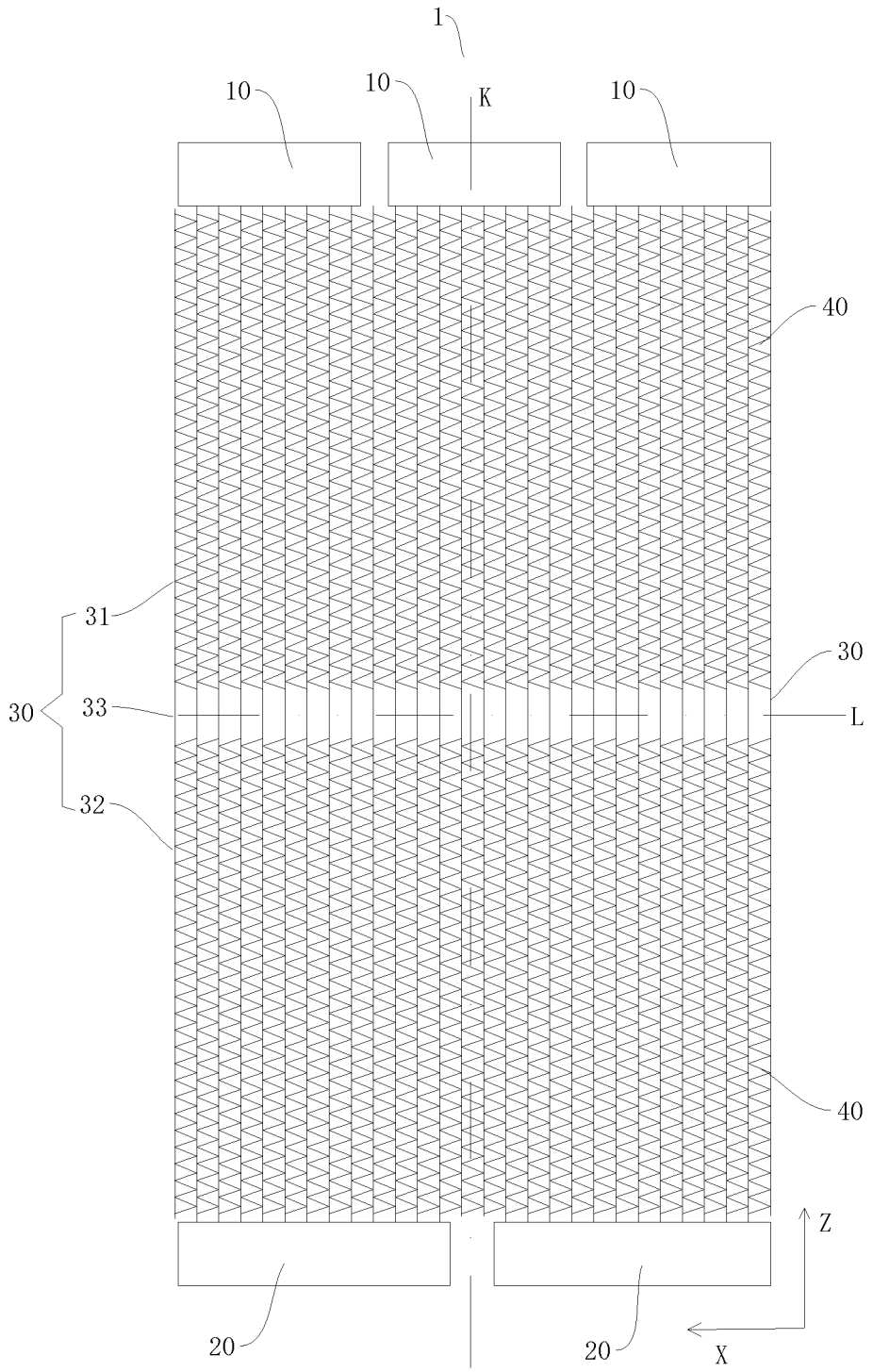
FIG. 14 is a schematic view of a heat exchanger before being bent according to a still further embodiment of the present disclosure.

As illustrated in FIG. 14, the heat exchanger 1 according to embodiments of the present disclosure includes at least two first headers 10, a second header 20, flat tubes 30 and fins 40.

The at least two first headers 10 are spaced apart from one another along axial directions of the first headers 10. The flat tube 30 is divided into a first straight segment 31, a second straight segment 32 and a twisted segment 33 along a length direction of the flat tube 30, and the twisted segment 33 is connected between the first straight segment 31 and the second straight segment 32. The second straight segments 32 of the flat tubes 30 are connected to the second header 20, and the first straight segments 31 of at least a part of the flat tubes 30 are connected to the at least two first headers 10. The fins 40 are disposed between adjacent first straight segments 31 and also between adjacent second straight segments 32.

The flat tube 30 is bent at the twisted segment 33 around a first bending axis L to provide a first bending portion 50, and the first bending axis L is parallel to the axial directions of the first header 10 and the second header 20. The first header 10 and the second header 20 are bent around at least one second bending axis K to provide at least one second bending portion 60. The first header 10 is located at an outer bending side of the second bending portion 60 and the second header 20 is located at an inner bending side of the second bending portion 60. The second bending axis K is orthogonal to the axial directions of the first header 10 and the second header 20 and parallel to length directions of the first straight segment 31 and the second straight segment 32.

For example, FIG. 14 illustrates an example in which two first headers 10 and one second bending portion 60 are provided. A direction X indicates the axial directions of the first header 10 and the second header 20 before being bent, and a direction Z indicates a length direction of the flat tube 30.

The first bending axis L extends in the X direction, and may be located at a center of the flat tube 30 in the Z direction. The second bending axis K extends in the Z direction, and may be located at a center of the second header 20 in the X direction. The second bending axis K passes through a gap between the two first headers 10. Before the heat exchanger 1 is bent around the first bending axis L, the first header 10 and the second header 20 are spaced apart from each other in the Z direction, while after the heat exchanger 1 bent around the first bending axis L, the first header 10 and the second header 20 are arranged in a width direction of the flat tube 30. Before the heat exchanger 1 is bent around the second bending axis K, distances between respective adjacent flat tubes 30 are equal to or unequal to one another, while after the heat exchanger 1 is bent around the second bending axis K, the distances between the respective adjacent flat tubes 30 will change with the bending of the first header 10 and the second header 20, and the distances between the respective adjacent flat tubes 30 are equal to or unequal to one another.

In the heat exchanger 1 according to embodiments of the present disclosure, the flat tube 30 is bent around the first bending axis L into two rows, and the first header 10 and the second header 20 are bent around the at least one second bending axis K, thereby providing a double-row bent structure. Thus, under the same heat-exchange capacity, diameters of the first header 10 and the second header 20 are reduced, such that a bending radius of the heat exchanger 1 around the second bending axis K is dramatically reduced, space utilization of the heat exchanger 1 is improved, and a bending area of the heat exchanger 1 is increased, thus resulting in high energy efficiency.

Furthermore, since a plurality of first headers 10 are provided and spaced apart from one another in the axial direction of the first header 10, after the being around the second bending axis K, the gap between the first headers 10 is deformed for self-adaptation during the bending, such that two ends of the second header 20 can be aligned with ends of the two first headers 10 located at the outermost side correspondingly, so as to prevent the heat exchanger 1 from being damaged due to deformation and twist, and also to avoid leakage of the heat exchanger 1, thus ensuring pressure and service life thereof. Additionally, the plurality of first headers 10 is provided such that an internal wastage of the heat-exchange capacity, due to a temperature difference between the refrigerants in adjacent chambers of the same header, can be prevented.

In general, in the heat exchanger 1 according to embodiments of the present disclosure, under a condition of the same heat-exchange capacity, the diameter of the header is reduced, such that the bending radius of the heat exchanger is reduced, thereby effectively utilizing the space, reducing the internal wastage of the heat-exchange capacity and improving the efficiency.

A double-row bent heat exchanger 1 according to a specific embodiment of the present disclosure will be described with reference to drawings in the following.

As illustrated in FIG. 14, the heat exchanger 1 according to embodiments of the present disclosure includes the at least two first headers 10, the second header 20, the flat tubes 30 and the fins 40.

Optionally, as illustrated in FIG. 14, the first straight segments 31 of a part of the flat tubes 30 are connected to the at least two first headers 10, and the rest part of the flat tubes 30 corresponding to a gap between adjacent first headers 10 each are a blind tube. The twisted segment of the blind tube is removed before the blind tube is bent. No fin 40 is provided between the first straight segments 31 of the blind tubes, and/or no fin 40 is provided between the second straight segments 32 of the blind tubes.

For example, a case in which two first headers 10 and one second bending portion 60 are provided is taken as an example. The second straight segments 32 of the flat tubes 30 are connected to the second header 20 separately. However, the first straight segments 31 of all the flat tubes 30 may be connected to the first header 10, in which case the gap between the two first headers 10 corresponds to a gap of a group of two adjacent flat tubes 30. Or, the first straight segments 31 of a part of the flat tubes 30 may be connected to the first header 10, in which case the flat tubes 10 corresponding to the gap between the two first headers 20 each are a blind tube.

For the flat tubes 30 corresponding to the gap between the two first headers 10, the fin 40 between the second straight segments 32 thereof may be a retractable doubled fin, or no fin is provided between the second straight segments 32 thereof; the fin 40 between the first straight segments 31 thereof may be a retractable doubled fin, or no fin is provided between the first straight segments 31 thereof.

Optionally, by setting the distribution of an inlet and an outlet in the plurality of first headers 10 and the second header 20, the heat exchanger 1 can be configured as a multi-flow heat exchanger or a single-flow heat exchanger.

Preferably, the heat exchanger 1 is the multi-flow heat exchanger, such that the heat-exchange performance can be effectively adjusted to reach an optimized heat-exchange performance.

A manufacturing method for the double-row bent heat exchanger according to embodiments of the present disclosure will be described in the following.

The manufacturing method for the double-row bent heat exchanger includes the following steps.

At least two first headers are provided and spaced apart from one another along axial directions thereof.

A second header is provided.

Flat tubes each are twisted around a twisting axis parallel to a length direction thereof so as to divide the flat tube into a first straight segment, a second straight segment and a twisted segment connected between the first straight segment and the second straight segment.

The flat tubes each are bent at the twisted segment around a first bending axis parallel to thickness directions of the first straight segment and the second straight segment so as to provide a first bending portion.

The second straight segments of the flat tubes are connected to the second header, and the first straight segments of at least a part of the flat tubes are connected to the at least two first headers.

Fins are arranged between adjacent first straight segments and between adjacent second straight segments.

The first header and the second header are bent around at least one second bending axis to provide at least one second bending portion. The first header is located at an outer bending side of the second bending portion and the second header is located at an inner bending side of the second bending portion. The second bending axis is orthogonal to axial directions of the first header and the second header and parallel to length directions of the first straight segment and the second straight segment.

In the heat exchanger according to embodiments of the present disclosure, the flat tube is first bent around the first bending axis into two rows, and then the first header and the second header are bent around the at least one second bending axis, thereby providing a double-row bent structure. Thus, under the same heat-exchange capacity, diameters of the first header and the second header are reduced, such that a bending radius of the heat exchanger around the second bending axis is dramatically reduced, space utilization of the heat exchanger is improved, and a bending area of the heat exchanger is increased, thus resulting in high energy efficiency.

Furthermore, since the at least two first headers are provided and spaced apart from one another in the axial directions thereof, after the bending around the second bending axis K, the gap between the first headers is deformed for self-adaptation during the bending, such that two ends of the second header can be aligned with ends of the two first headers located at the outermost side correspondingly, so as to prevent the heat exchanger from being damaged due to deformation and twist, and also to avoid the leakage of the heat exchanger, thus ensuring the pressure and the service life thereof. Additionally, the plurality of first headers 10 is provided such that an internal wastage of the heat-exchange capacity, due to a temperature difference between the refrigerants in adjacent chambers of the same header, can be prevented.

In general, with the manufacturing method for the heat exchanger according to embodiments of the present disclosure, under a condition of the same heat-exchange capacity, a diameter of the header can be reduced, such that the bending radius of the heat exchanger is reduced, thereby effectively utilizing the space, reducing the internal wastage of the heat-exchange capacity and improving the efficiency.

In some specific embodiments of the present disclosure, the first straight segments of a part of the flat tubes are connected to the at least two first headers, and the rest part of the flat tubes corresponding to the gap between adjacent first headers each are a blind tube. No fin is provided between the first straight segments of the blind tubes, and/or no fin is provided between the second straight segments of the blind tubes. Thus, the heat exchanger can be configured as the multi-flow heat exchanger, such that the heat-exchange performance can be effectively adjusted to reach an optimized heat-exchange performance.

The heat exchanger 1 according to embodiments of the present disclosure has a double-row bent structure. Thus, under the same heat-exchange capacity, diameters of the first header 10 and the second header 20 are reduced, such that a bending radius of the heat exchanger 1 around the second bending axis K is dramatically reduced, space utilization of the heat exchanger 1 is improved, and a bending area of the heat exchanger 1 is increased, thus resulting in high energy efficiency. Furthermore, outer ends of the first header 10 are aligned with outer ends of the second header 20 after the bending, so as to prevent the heat exchanger 1 from being damaged due to deformation and twist, and also to avoid leakage of the heat exchanger 1, thus ensuring pressure and service life thereof.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial"

and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature. While a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat exchanger, comprising:

a first header and a second header, a length of the second header being less than a length of the first header;

flat tubes each divided into a first straight segment connected to the first header, a second straight segment connected to the second header and a twisted segment connected between the first straight segment and the second straight segment, along a length of the flat tube; and fins disposed between adjacent first straight segments and between adjacent second straight segments, wherein the flat tube has a first bending portion bent at the twisted segment around a first bending axis, and the first bending axis is parallel to axial directions of the first header and the second header, wherein the first header and the second header have at least one second bending portion bent around at least one second bending axis, the first header is located at an outer bending side of the second bending portion and the second header is located at an inner bending side of the second bending portion, the second bending axis is orthogonal to the axial directions of the first header and the second header, and the second bending axis is parallel to length directions of the first straight segment and the second straight segment, wherein the first header is arranged adjacent to the second header, one end of the first header is aligned with one end of the second header along the axial directions of the first header and the second header, and the other end of the first header is aligned with the other end of the second header along the axial directions of the first header and the second header.

2. The heat exchanger as set forth in claim 1, wherein a center of the first header along the axial direction thereof is aligned with a center of the second header along the axial direction thereof.

3. The heat exchanger as set forth in claim 2, wherein one second bending portion is provided, the first header and the second header each has an arc shape, the first straight segments of the flat tubes are arranged in an arc shape along the axial direction of the first header, and the second straight segments of the flat tubes are arranged into in an arc shape along the axial direction of the second header.

4. The heat exchanger as set forth in claim 1, wherein distances between respective adjacent flat tubes are equal to or unequal to one another.

5. A heat exchanger, comprising:

a first header and at least two second headers, the at least two second headers being spaced apart from one another along axial directions thereof;

flat tubes each divided into a first straight segment, a second straight segment and a twisted segment along a length of the flat tube, the twisted segment being connected between the first straight segment and the second straight segment, the first straight segments of the flat tubes being connected to the first header, and the second straight segments of at least a part of the flat tubes being connected to the at least two second headers; and fins disposed between adjacent first straight segments and between adjacent second straight segments, wherein the flat tube has a first bending portion bent at the twisted segment around a first bending axis, and the first bending axis is parallel to axial directions of the first header and the second header, wherein the first header and the second header have at least one second bending portion bent around at least one second bending axis, the first header is located at an outer bending side of the second bending portion and the second header is located at an inner bending side of the second bending portion, the second bending axis is orthogonal to the axial directions of the first header and the second header, and the second bending axis is parallel to length directions of the first straight segment and the second straight segment, wherein the second straight segments of a part of the flat tubes are connected to the at least two second headers, and a rest part of the flat tubes corresponding to a gap between adjacent second headers each are a blind tube.

6. The heat exchanger as set forth in claim 5, wherein no fin is provided between the first straight segments of the blind tubes, and/or no fin is provided between the second straight segments of the blind tubes.

7. The heat exchanger as set forth in claim 5, wherein a plurality of the first headers are provided, and the plurality of the first headers are spaced apart from one another along the axial directions thereof.

8. The heat exchanger as set forth in claim 7, wherein the heat exchanger is a multi-flow heat exchanger or a single-flow heat exchanger.

9. A heat exchanger, comprising:

at least two first headers spaced apart from one another along axial directions thereof;

a second header;

flat tubes each divided into a first straight segment, a second straight segment and a twisted segment along a length of the flat tube, the twisted segment being connected between the first straight segment and the second straight segment, the second straight segments of the flat tubes being connected to the second header, and the first straight segments of at least a part of the flat tubes being connected to the at least two first headers; and fins disposed between adjacent first straight segments and between adjacent second straight segments, wherein the flat tube has a first bending portion bent at the twisted segment around a first bending axis, and the first bending axis is parallel to axial directions of the first header and the second header, wherein the first header and the second header have at least one second bending portion bent around at least one second bending axis, the first header is located at an outer bending side of the second bending portion and the second header is located at an inner bending side of the second bending portion, the second bending axis is orthogonal to the axial directions of the first header and the second header, and the second bending axis is parallel to length directions of the first straight segment and the second straight segment, wherein the first straight segments of a part of the flat tubes are connected to the at least two first headers, and a rest part of the flat tubes corresponding to a gap between adjacent first headers each are a blind tube.

10. The heat exchanger as set forth in claim 9, wherein no fin is provided between the first straight segments of the blind tubes, and/or no fin is provided between the second straight segments of the blind tubes.

* * * * *